United States Patent [19]

Seegmiller

[11] Patent Number: 4,661,022

[45] Date of Patent: Apr. 28, 1987

[54] ROCK BOLT STRUCTURE AND INSTALLATION

[76] Inventor: Ben L. Seegmiller, 3500 Loren Von Dr., Salt Lake, Utah 84124

[21] Appl. No.: 797,937

[22] Filed: Nov. 14, 1985

[51] Int. Cl.[4] ..... E21D 20/02

[52] U.S. Cl. ..... 405/260; 405/261; 411/452; 411/516

[58] Field of Search ..... 405/259, 260, 261; 411/479, 478, 477, 446, 447, 451–456, 19

[56] References Cited

U.S. PATENT DOCUMENTS

| | | | |
|---|---|---|---|
| 412,981 | 10/1889 | Sanford | 411/477 |
| 778,858 | 1/1905 | Higgins | 411/452 |
| 2,014,746 | 9/1935 | Robergel | 411/452 X |
| 2,299,754 | 10/1942 | Johnson | 411/516 |
| 3,391,543 | 7/1968 | Sweeney et al. | 405/259 |
| 3,415,066 | 12/1968 | Williams | 405/260 |
| 3,643,542 | 2/1972 | Elders | 405/259 X |
| 4,185,438 | 1/1980 | Fischer | 405/260 X |
| 4,325,657 | 4/1982 | Elders | 405/259 |
| 4,334,804 | 6/1982 | Lindeboom | 405/259 |

*Primary Examiner*—Dennis L. Taylor

*Attorney, Agent, or Firm*—M. Ralph Shaffer

[57] ABSTRACT

Rock bolt structure and installation wherein the bolt takes the form of an elongate member having an enlarged head and also an elongate, blade-like shank. The opposite edges at the remote tip of the shank are slightly tapered, this to provide ease of installation in a rock formation hole or aperture. The width of the shank is designed so as to be slightly larger than the diameter of the hole. Thus, when the bolt is driven into the hole, there will be a friction fit and hence a frictional retention of the bolt at its edges by the hole wall. A bearing plate will be provided, the same having a slotted aperture to accommodate the blade-like shank of the bolt. Additionally, a relief aperture will be provided in the bearing plate to accommodate insertion of a grout fitting. The latter is supplied an impact tool, the same also having a relief aperture accommodating the head of the bolt. The opposite sides of the bolt shank are preferably roughened, i.e., serrated or dimpled, so as to increase the retention of the bolt in the hole through the employment of a grouted installation, the latter being accommodated by the impact tool of the invention.

12 Claims, 12 Drawing Figures

ROCK BOLT STRUCTURE AND INSTALLATION

FIELD OF INVENTION

The present invention relates to rock bolts and their installations and, more particularly, provides a new type of mine bolt having a shank, a blade-like configurement, the opposite edges of which are oversized relative to a hole in which the shank is to be implaced. Impact tool structural means are provided both for impacting the bolt within a rock formation hole and also for supplying grout in a forced feed along one side of the blade shank, then around its end, and subsequently doubled back so as to completely fill the hole on opposite sides of the blade shank. Such shank is preferably dimpled, serrated, or otherwise configured so as to increase the shear retention of the bolt within the hole.

DESCRIPTION OF PRIOR ART

In the past rock bolts have taken several forms. One type is simply a standard reinforcing bar cut to desired lengths, i.e., five to seven feet. Other types of bars have built-in transverse resiliency, forming "S" sections or "C" sections. Accordingly, when the transverse radial cross-section is thus, then the bolt or bar can be slightly oversize relative to the hole and then pounded or impacted into the hole so as to squeeze the opposite edges of the "S" or compress slightly the "C" cross-section of the bolt. This provides for a compressive force applied to the walls of the hole at aperture wall areas of contact with the corresponding outer surfaces of the bolt.

There is a problem, however, in the possibility of corrosion of the bolt at enlarged areas of contact circumferentially as to rebar, also for compression C-section bolts, and likewise as to opposite outer edges of the "S" bolts having S-shaped transverse cross-sections. It would be desirable, therefor, to minimize possibilities of corrosion and yet provide for a friction fit as between the bolt and the hole wall. It would likewise be desirable to provide a tool for impacting the bolt into a rock formation hole, this incorporating in structure wherein grout can be introduced into the mine roof aperture on opposite sides of the bolt when the latter is satisfactorily installed.

BRIEF DESCRIPTION OF PRESENT INVENTION

According to the present invention the rock bolt contemplated herein includes a headed end and an elongate shank in a form essentially of a blade. The shank has a near end and a remote end the latter of which has edges that are inwardly tapered toward the extremity of such remote end. This aids in preliminary bolt insertion in a rock formation hole. The opposite edges of the blade-configured shank are slightly oversized relative to the diameter of the hole in which the shank is to be thrust. Thus, there will be a tight frictional engagement as between the opposite edges of the shank and the hole wall. There is a contact of the bolt with the wall of the rock formation hole or aperture which would be restricted essentially to the opposite edges of the bolt shank; hence, while there will be a friction fit accomplished, yet corrosive effects will be restricted essentially to the opposite edges of the bolt shank. Accordingly, possibilities of failure due to corrosion of the bolt will be minimized.

A bearing plate is also provided, the same having a medial slot configured to receive the blade-like shank of the bolt; also provided in the bearing plate is an aperture for receiving a grout fitting, the latter being part of a new and useful impact tool as provided herein. Such impact tool in a preferred form thereof will include a centering boss made integral with a flange. The flange has a central relief aperture accommodating the headed end of the bolt as a relief area. The flange itself will be provided with a side threaded aperture, or other suitable passageway means for receiving an end fitting such as a union. A union, for example, can be coupled to a pressure hose coming from a grout-supplying machine. This side aperture of the impact tool can also accommodate a grout fitting that is implaced through the hole in the bearing plate so that the grout can be forced under pressure into the hole on one side of the blade shank of the bolt and then subsequently routed back over the end of the shank to the other side thereof. Preferably, and to increase the shear strength of the bolt implacement, the opposite sides of the shank of the bolt will be dimpled, serrated, or otherwise made undulating so as to increase the holding power of the grout relative to the bolt sides.

OBJECTS

Accordingly, a principal object of the invention is to provide a new and improved rock bolt, and preferably with increased holding power.

A further object is to provide a rock formation bolt having a blade-like shank with opposite, tapered, remote edges.

A further object is to provide a rock bolt wherein possibilities of corrosion are minimized and, in fact, are restricted essentially to the edges of a blade-like shank provided the bolt.

A further object is to provide a mine roof bolt installation wherein the same incorporates grout on both sides of the rock bolt when the same is installed in a mine roof aperture.

A further object is to provide with a rock bolt a bearing plate, the latter incorporating a central slit to receive the blade-like shank of the bolt and also providing a side aperture as an accommodation for pressured grout installation.

A further object is to provide as a separate element and also in combination with the rock bolt and bearing plate an impact tool, the same incorporating a flange having a central relief area accommodating the headed end of the bolt, and also a side grout fitting accommodating attachment thereof to an exterior grout pressure-feeding machine, such fitting being introduced through the bearing plate and slightly into the mine roof aperture on one side of the bolt shank.

BRIEF DESCRIPTION OF THE DRAWINGS

The present invention may best be understood by reference to the following description, taken in connection with the accompanying drawings in which.

DETAILED DESCRIPTION OF PREFERRED EMBODIMENTS

Figure 2:
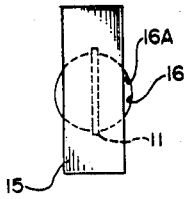
FIG. 2 is an end view of the left end of the structure of FIG. 1.
Figure 1:
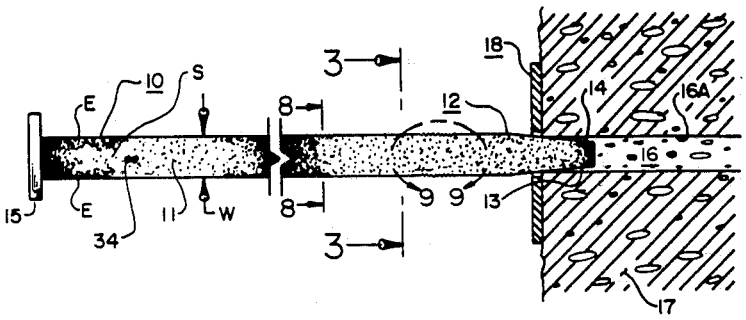
FIG. 1 is a side elevation of a rock bolt constructed in accordance with the principles of the present invention, the same being positioned for impact-insertion into the hole or aperture of a rock formation such as a mine roof; for convenience of illustration this figure is rotated 90° in a clockwise direction.
Figure 3:
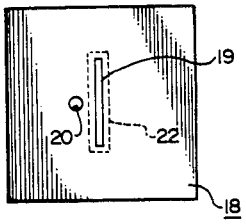
FIG. 3 is an enlarged view, taken along the line 3—3 in FIG. 1, of a representative bearing plate that can be employed in the invention.

In FIG. 1 the rock bolt 10 is shown to include a blade-like shank 11 having tapered end 12 formed of tapered edges 13 and 14. Shank 11 is provided with enlarged head 15 and can be toothed at edges E to provide for increased frictional effect. The rock bolt in FIG. 1 is shown in preparatory condition for an impact-thrusting into the hole or aperture 16 of rock formation 17. The width W of the blade-like shank 11 is seen to be greater in dimension than the diameter of aperture 16, i.e., at diametrically opposed points along aperture wall 16A. Bearing plate 18, see also FIG. 3, is shown to include a central slit-like aperture 19 designed to accommodate the blade shank 11. Dotted line 22 signifies the locus of the periphery of head 15 when the rock bolt is thrust home through the bearing plate. Aperture 20 is designed to accommodate a grout fitting such as fitting 21 which is illustrated in FIG. 4, about to be described.

Figure 4:
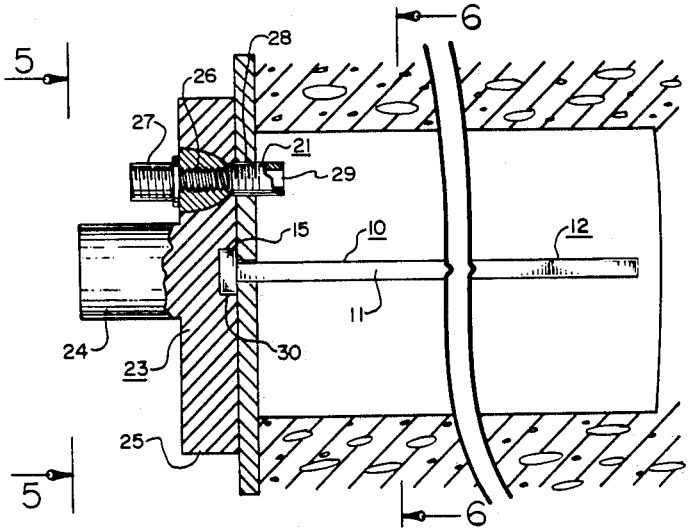
FIG. 4 is an enlarged side elevation, and partially sectioned, showing the rock bolt as being installed, this being accomplished by employment of an impact tool as illustrated a portion of which is sectioned.
Figure 5:
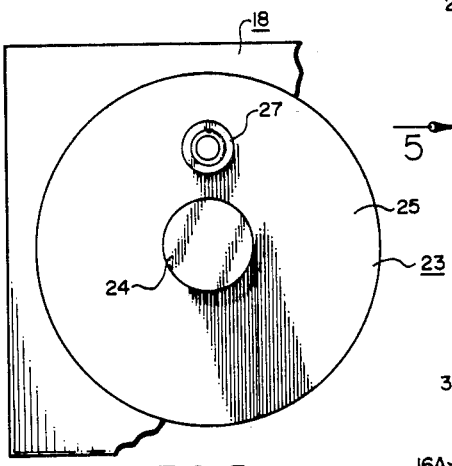
FIG. 5 is a view taken along the line 5—5 in FIG. 4, illustrating a top plan of the impact tool employed in FIG. 4.
Figure 6:
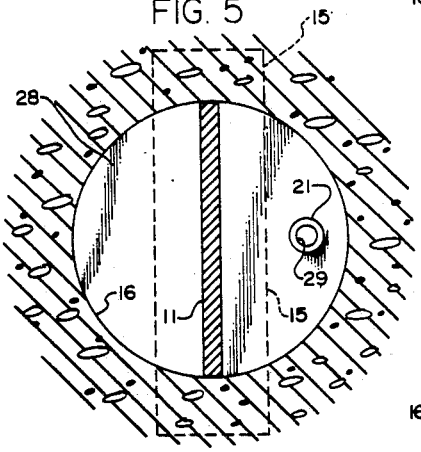
FIG. 6 is a side elevation of the reverse side of the impact tool of FIG. 5.

In FIG. 4 an impact tool 23 is seen, and includes a central boss 24 and also a flange 25 integral therewith. Flange 25 has a threaded aperture 26 that receives union 27. An enlarged threaded aperture 28 is concentric with threaded aperture 26 and, as seen, receives grout fitting 21. The same may be secured in place by threads, as seen, or by any other suitable means. Grout fitting 21 includes central aperture 29 which is designed to pass grout under pressure from external equipment coupled to union 27 into the mine roof hole or aperture at 16.

Impact tool 23 has a relief area 30 that is configured to receive the head 15, serving as a relief area therefor.

In construction, again, the width W of the blade portion or shank 11 of rock bolt 10 will be slightly larger than the hole 16 into which it is to be driven. This oversized dimension will be probably from one-eighth to one-quarter of an inch, this so as to ensure a snug, frictioned fit as between the opposite edges E of the blade shank and the opposite holes along the wall 16A with which such edges are engaged.

The bearing plate 18 in FIG. 3 is slipped over the shank portion of the rock bolt to abut against the internal shoulder of head 15. The rock bolt is then driven home, into the hole by virtue of the thrust-impaction of impact tool 23.

It is noted that the hole 16 should be longer than the length of the tool. Thus, when grout is introduced through union 27 and forced through aperture 29 the same will proceed along the arrow F and be doubled back about the end of the blade-shank of the rock bolt so as to completely fill the void along both sides of the blade.

Once the grout has been introduced, then the impact tool is simply withdrawn.

Figure 8A:
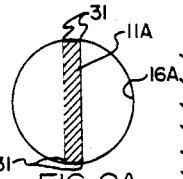
FIGS. 8A, 8B, 8C and 8D are transverse sections taken along the line 8—8 in FIG. 1, showing various, representative, alternative embodiments of the bolt shank.
Figure 8B:
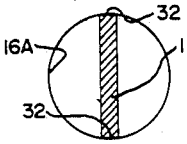
Figure 8C:
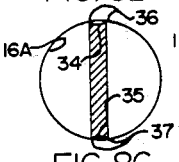
Figure 8D:
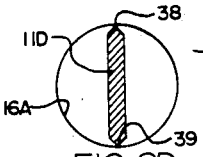
Figure 7:
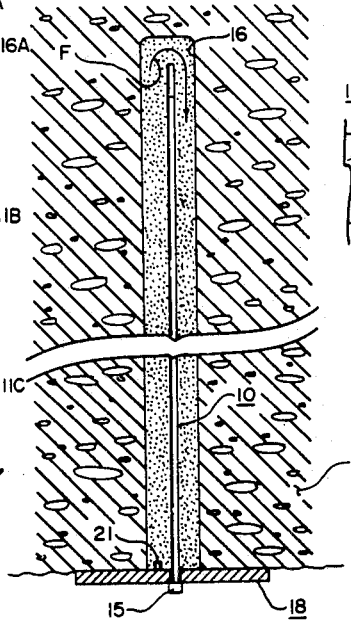
FIG. 7 is a fragmentary view, principally in section, of, e.g., a mine roof structure illustrating the bolt of the present invention as being installed in a hole in the mine roof, the latter securing the bearing plate against the roof strata, and illustrating the impact tool as being removed.

Various cross-sectional forms of shank 11 are shown at 11A, 11B, 11C, and 11D in FIGS. 8A through 8D. The particular form selected will be determined by the type of rock formation to be experienced. In FIG. 8A the four contact edges 31 are seen to bite into the aperture wall 16A. In FIG. 8B the opposite longitudinal edges 32, 33 are rounded and correspond essentially with the aperture wall curvature. In FIG. 8C the edges 34, 35 are concave so as to render more prominent the formation cutting edges 36, 37. And in FIG. 8D the edges 38, 39 form a pair of apexes.

Figure 9:
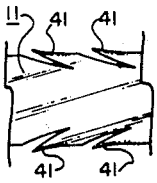
FIG. 9 is an enlarged detail of one type of shank and is taken along the arcuate line 9—9 in FIG. 1.

In FIG. 9 barbs 40 are formed in bolt shank 11 and are directed reverse to the direction toward the shank remote end, whereby to increase the holding power of the bolt along its serrated or toothed shank edges E.

It is noted, thus, that the invention provides an inexpensive and yet highly novel and versatile way of securing rock bolts in roof apertures in a coal mine or other type of mine, thus providing a very secure anchor for the bearing plates or for other attachments as might be applied in rock formation structures.

To increase the shear strength of the roof bolt installation, the sides S at opposite sides of the blade shank may be dimpled or serrated as shown at 34 so that the grout will fill these crevices or undulations and thus increase in shear the holding power of the bolt within its grouted placement.

Thus, the roof bolt provides a secure friction fit such that corrosion can be experienced only at the edge surfaces of edges E of the bolt. Yet, the frictional retentive power of edge engagement with the wall of the aperture is enhanced by the employment of grout on both sides of the shank of the bolt.

While it is contemplated that the principal usage of the rock bolt construction will be as a mine roof bolt, it will be understood, from use of the generic term "rock bolt", that the same can be used in mine ribs and floors, and underground caves, tunnels, storage vaults and other rock formation, and toxic waste respositories, underground power stations or other caverns, and so forth.

While particular embodiments of the present invention have been shown and described, it will be obvious to those skilled in the art that changes and modifications may be made without departing from this invention in its broader aspects, and, therefor, the aim in the appended claims is to cover all such changes and modifications as fall within the true spirit and scope of this invention.

I claim:

1. In combination, a rock formation having a predrilled hole of round transverse cross-section; a rock bolt having a headed end and a flat, essentially rectangular non-apertured blade-like shank of thin rectangular cross-section integral with, indented with respect to, and extending from said headed end to a remote end, said shank being shorter than and being disposed in said hole, said shank having closely spaced opposite sides and opposite elongate edges spanning said sides and frictionally engaging said hole at its wall, said edges being tapered inwardly solely proximate and approaching said remote end; and grout means disposed in said hole on opposite sides of said shank and about said remote end.

2. The structure of claim 1 wherein said shank is serrated on its sides.

3. The structure of claim 1 wherein said shank is dimpled on its sides.

4. The structure of claim 1 wherein said sides of said shank have irregular surfaces.

5. In combination: a rock formation having a circular hole; a rock bolt having a headed end and a flat, think, blade-like shank integral with and extending from said headed end to a remote end, said shank having opposite elongate edges frictionally engaging said hole at its wall; said edges being tapered inwardly approaching said remote end; a bearing plate overlapping said hole and having a rectangular slot receiving said shank and also a grout-receiving side aperture, said bearing plate being mounted on said bolt over said shank, said side aperture being disposed beyond said headed end; and grout forced through said side aperture and deposited on opposite sides of said also about said remote end of said shank.

6. In combination, a rock bolt having a headed end and a flat, thin, non-apertured elongate essentially rectangular shank integral therewith and indented with respect thereto and proceeding to a remote end, said shank being provided with fin edges which taper inwardly solely proximate and toward said remote end; and grout means disposed on opposite sides of and about said remote end of said shank for cementing said shank in an external rock-bolt bore hole provided an external rock formation.

7. The structure of claim 6 wherein the transverse cross-section of said shank is rectangular.

8. The structure of claim 6 wherein said fin edges have concave cross-sections.

9. The structure of claim 6 wherein said fin edges are convex in general correspondence with external, aperture-wall contour.

10. The structure of claim 8 wherein said edges form apexes.

11. The structure of claim 6 wherein said edges are provided with mutually-spaced barbs pointing in a direction reverse to said shank remote end.

12. In combination with a rock formation having a cylindrical bore hole wall, a rock bolt, of less longitudinal dimension than said bore hole wall, having a headed end and a flat, essentially rectangular blade-like shank of thin rectangular cross-section integral with, indented with respect to, and extending from said headed end to a remote end, said shank having closely spaced opposite sides and opposite elongated edge spanning said sides and frictionally engaging said wall, said edges being tapered inwardly solely proximate and approaching said remote end; and grout means disposed between said shank sides and said bore hole wall and also around said remote end for cementing said rock bolt in place.

* * * * *